US006897609B2

(12) United States Patent
Krisl et al.

(10) Patent No.: US 6,897,609 B2
(45) Date of Patent: May 24, 2005

(54) PLASMA LAMP AND METHOD

(75) Inventors: Eric Krisl, Santa Rosa, CA (US); Abbas Lamouri, Aurora, OH (US); Leonid Pekker, Santa Rosa, CA (US); Paul Morand, Rohnert Park, CA (US); Juris Sulcs, Chagrin Falls, OH (US); Norman L. Boling, Santa Rosa, CA (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 10/112,024

(22) Filed: Apr. 1, 2002

(65) Prior Publication Data

US 2002/0195943 A1 Dec. 26, 2002

Related U.S. Application Data

(60) Provisional application No. 60/279,685, filed on Mar. 30, 2001.

(51) Int. Cl.[7] ..... H01J 17/20; H01J 61/12

(52) U.S. Cl. ..... 313/570; 313/112; 313/635; 313/638; 313/640

(58) Field of Search ..... 313/567, 570–574, 313/635, 637–640, 110–112

(56) References Cited

U.S. PATENT DOCUMENTS 3,234,421 A 2/1966 Reiling
4,020,377 A 4/1977 Popp et al.
5,363,007 A * 11/1994 Fromm et al. ..... 313/25
5,471,110 A 11/1995 van der Leeuw et al.
5,552,671 A 9/1996 Parham et al.
5,610,469 A * 3/1997 Bergman et al. ..... 313/25
5,646,472 A 7/1997 Horikoshi
5,694,002 A 12/1997 Krasko et al.
5,751,111 A 5/1998 Stoffels et al.
5,849,162 A 12/1998 Bartolomei et al.
6,005,346 A * 12/1999 Shaffner ..... 313/637
6,072,268 A * 6/2000 Dolan et al. ..... 313/112
6,229,252 B1 * 5/2001 Teng et al. ..... 313/112
6,605,888 B1 * 8/2003 Waymouth et al. ..... 313/112

* cited by examiner

*Primary Examiner*—Ashok Patel
(74) *Attorney, Agent, or Firm*—Duane Morris LLP

(57) ABSTRACT

An apparatus and method for achieving desired spectral emission characteristics in plasma lamps is disclosed. The apparatus and method use multi-layer thin film optical interference coatings to selectively reflect a portion of the light such that it can be absorbed in the plasma. The multi-layer thin film coating is applied to any surface of the lamp, which substantially surrounds the plasma. The number and thickness of the layers in the coating are selected to ensure that a significant portion of the selected light emitted from the plasma is reflected by the coating and absorbed by the plasma. The properties of the coating, reflectance, transmittance and absorption are determined as a function of plasma and lamp characteristics. These characteristics include the spectral emission characteristics of the plasma, the spectral absorption characteristics of the plasma, the physical dimensions of the plasma, the angular distribution of the light emitted from the plasma on the coating and the geometry of the coated surface.

8 Claims, 5 Drawing Sheets

CRI Coating Design Performance

CRI vs valley center location

CRI and CCT Versus Reduction In LPW

PLASMA LAMP AND METHOD

RELATED APPLICATIONS

This application claims the benefit of U.S. Provisional Patent Application No. 60/279,685 filed Mar. 30, 2001.

BACKGROUND OF THE INVENTION

The present invention generally relates to electric lamps and methods of manufacture. More specifically, the present invention relates to lamps wherein the light source includes a light emitting plasma contained within an arc tube (i.e. plasma lamps) having dichroic thin film coatings to improve the operating characteristics of the lamp.

Plasma lamps such as mercury lamps or metal halide lamps have found widespread acceptance in lighting large outdoor and indoor areas such as athletic stadiums, gymnasiums, warehouses, parking facilities, and the like, because of the relatively high efficiency, compact size, and low maintenance of plasma lamps when compared to other lamp types. A typical plasma lamp includes an arc tube forming a chamber with a pair of spaced apart electrodes. The chamber typically contains a fill gas, mercury, and other material such as one or more metal halides, which are vaporized during operation of the lamp to form a light emitting plasma. The operating characteristics of the lamp such as spectral emission, lumens per watt ("LPW"), correlated color temperature ("CCT"), and color rendering index ("CRI") are determined at least in part by the content of the lamp fill material.

The use of plasma lamps for some applications has been limited due the difficulty in realizing the desired spectral emission characteristics of the light emitting plasma. For example, metal halide lamps were introduced in the United States in the early 1960's and have been used successfully in many commercial and industrial applications because of the high efficiency and long life of such lamps compared to other light sources. However, metal halide lamps have not as yet found widespread use in general interior retail and display lighting applications because of the difficulty in obtaining a spectral emission from such lamps within the desired range of CCT of about 3000–4000 K and CRI of greater than about 80.

Relatively high CRI (>80) has been realized in metal halide lamps having a CCT in the desired range by the selection of various metal halide combinations comprising the lamp fill material. For example, U.S. Pat. No. 5,694,002 to Krasko et al. discloses a metal halide lamp having a quartz arc tube with a fill of halides of sodium, scandium, lithium, and rare earth metals, which operates at a CCT of about 3000 K and a CRI of about 85. U.S. Pat. No. 5,751,111 to Stoffels et al. discloses a metal halide lamp having a ceramic arc tube with a fill of halides of sodium, thallium and rare earth metals which operates at a CCT of about 3000 K and a CRI of about 82. However, the quartz lamps disclosed by Krasko et al. have a relatively low LPW, the ceramic lamps disclosed by Stoffels et al. are relatively expensive to produce, and both types of lamps have a relatively high variability in operating parameters and a relatively diminished useful operating life.

The use of a sodium/scandium based halide fill in plasma lamps has addressed the efficiency and variability problems by providing improved efficiency and lower variability in operating parameters relative to metal halide lamps having other fill materials. However, such lamps have a relatively low CRI of about 65–70 and thus are not suitable for many applications.

One known approach in improving certain operating characteristics of plasma lamps is to filter the light emitted from the plasma. Recent developments in thin film coating technology have increased the utility of such coatings in the lighting industry by improving both the thermal capability of the coatings and the uniformity of such coatings when applied to curved surfaces such as the arc tubes, reflectors, and outer envelopes of lamps. The MicroDyn ® reactive sputtering process of Deposition Sciences, Inc. of Santa Rosa, Calif., as disclosed and claimed for example in U.S. Pat. No. 5,849,162 is particularly suitable for depositing a variety of thin film coatings useful in lighting applications. Other known coating processes such as chemical vapor deposition, thermal evaporation, and ion and electron beam deposition may also be suitable for lighting applications.

It is a characteristic of such coatings that they selectively reflect and/or absorb radiation at selected wavelengths. For example, U.S. Pat. No. 5,552,671 to Parham et al. discloses a multilayer UV radiation absorbing coating on the arc tubes of metal halide lamps to block UV radiation. U.S. Pat. No. 5,646,472 to Horikoshi discloses a metal halide lamp having a dysprosium based fill with a multilayer coating on the arc tube for reflecting light at wavelengths shorter than nearly 600 nm while transmitting light at longer wavelengths to lower the CCT of the lamp. However, the optimal utilization of thin film coatings to control certain operating characteristics of plasma lamps often requires that a significant portion of the light that is selectively reflected by the coating be absorbed by the plasma, and there remains a need for thin film coatings for plasma lamps directed to plasma absorption.

It is accordingly an object of the present invention to obviate many of the deficiencies of the prior art and to specifically address the plasma absorption of reflected light in the improvement of the operating characteristics of plasma lamps.

Another object of the present invention is to improve the effectiveness of thin film coatings used in plasma lamps by consideration of the absorption of reflected light in the plasma in the design and fabrication of such coatings.

Still another object of the present invention is to provide a novel multilayer thin film filter and method for plasma lamps.

Yet another object of the present invention is to provide a novel plasma lamp with improved operating characteristics and method of manufacturing such plasma lamps.

Still yet another object of the present invention to provide a novel plasma lamp and method using multilayer thin film coatings to obtain the desired spectral emission characteristics for the lamp.

A further object of the present invention is to provide a novel plasma lamp and method of making plasma lamp with operating characteristics suitable for indoor retail and display lighting.

Yet a further object of the present invention to provide a novel metal halide lamp and method having a highly selective notch in transmissivity.

Still a further object of the present invention to provide a novel method of making multilayer thin film coatings for plasma lamps wherein the number and thickness of the layers in the coating are determined as a function of the spectral and/or physical characteristics of the plasma.

Yet still a further object of the present invention to provide a novel method of making multilayer thin film coatings for plasma lamps wherein the number and thickness of the layers in the coating are determined as a function of the geometry of the surface to be coated and/or and angular distribution of the light emitted from the plasma on the coating.

It is still another object of the present invention to provide a novel sodium/scandium lamp and method.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention finds utility in the manufacture of all types and sizes of plasma lamps. As discussed above, plasma lamps have found widespread acceptance in many lighting applications, but the use of plasma lamps in some applications may be limited due to the difficulty in realizing the desired spectral emission characteristics of the light emitting plasma in such lamps. It has been discovered that multilayer thin film optical interference coatings designed so that a significant portion of the light that is selectively reflected by the coating is absorbed by the plasma provide a means for obtaining the desired spectral emission characteristics while maintaining or improving the overall operating characteristics of plasma. By way of example only, certain aspects of the present invention will be described in connection with obtaining the desired spectral emission characteristics in sodium/scandium metal halide lamps to raise the CRI of such lamps.

Figure 1:
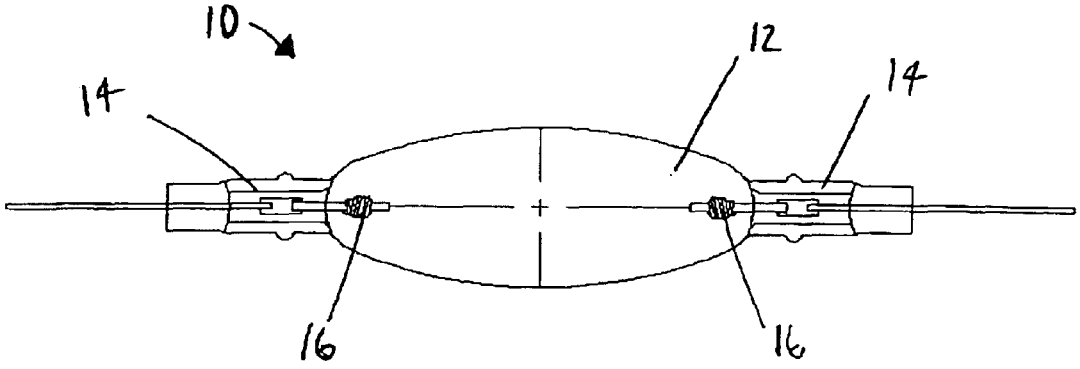
FIG. 1 is an illustration of a formed body arc tube for plasma lamps.

FIG. 1 illustrates a formed body arc tube suitable for use in sodium/scandium metal halide lamps. With reference to FIG. 1, the arc tube 10 is formed from light transmissive material such as quartz. The arc tube 10 forms a bulbous chamber 12 intermediate pinched end portions 14. A pair of spaced apart electrodes 16 are sealed in the arc tube, one in each of the pinched end portions 14. The chamber 12 contains a fill gas, mercury, and one or more metal halides.

During operation of the lamp, an arc is struck between the electrodes 16 that vaporizes the fill materials to form a light emitting plasma. According to the present invention, a multilayer thin film coating may be applied to any surface in the lamp which substantially surrounds the plasma, e.g., the arc tube, an arc tube shroud, the outer lamp envelope, or a reflector. According to certain aspects of the present invention, the number and thickness of the layers comprising the coating are determined so that a significant portion of the light emitted from the plasma that is selectively reflected by the coating is absorbed in the plasma. In the coatings of the present invention directed to plasma absorption, the properties of the coating (including reflectance, transmittance, and absorption) are determined as a function of several plasma and lamp characteristics including the spectral emission characteristics of the plasma, the spectral absorption characteristics of the plasma, the physical dimensions of the plasma, the angular distribution of the light emitted from the plasma on the coating, and the geometry of the coated surface.

To obtain a desired spectral emission from a plasma lamp using a filter, the target spectral emission lines must be identified by analysis of the unfiltered spectral emission of the lamp. The filter must then be designed so that desired portions of the light emitted by the plasma at the target wavelengths are reflected by the filter and absorbed in the plasma to thereby selectively remove such light from the light transmitted from the lamp.

Once the target spectral lines have been identified, the physical dimensions of the specific arc in the plasma that primarily emit the light at each targeted wavelength are measured to determine the region within the plasma that the reflected light must be directed for absorption.

The spectral absorption characteristics of the plasma are then determined either theoretically by consideration of arc temperature and the densities of the mercury and metal halides, or experimentally based on measured spectral emittance changes caused by the application of highly reflective coatings to the arc tube.

The angular distribution of the light emitted from the plasma on the filter must also be determined so that the angle of incidence may be considered in the coating design. The geometry of the filter (i.e. the coated surface), and the physical dimensions of the plasma may be used to determine the angular distribution of the emitted light at each point on the filter.

In view of the dimensions of the plasma and the angular distribution of the emitted light on the filter, the absorption of light in the plasma as a function of the reflectivity of the filter may be predicted.

The reflectivity levels at each spectral emission wavelength of interest for the filter may then be targeted to obtain the desired spectral transmission from the lamp. The number and thickness of the layers comprising the multilayer coating may then be determined using techniques that are common in the thin film coating art to obtain a coating having the desired properties.

The coating may be deposited using any suitable deposition process such as reactive sputtering, chemical vapor deposition, thermal evaporation, and ion or electron beam deposition. A suitable multilayer coating typically includes alternating layers of materials having differing indices of refraction.

A typical sodium/scandium metal halide lamps includes a fill comprising a fill gas selected from the gases neon, argon, krypton, or a combination thereof, mercury, and halides of sodium and scandium. The fill material may also include one or more additional halides of metals such as thorium and metals such as scandium and cadmium.

In the aspect of the present invention directed to raising the CRI of sodium/scandium metal halide lamps, based on an analysis of the spectral emission of such lamps, it has been determined that the CRI of the light transmitted by a notch filter that reflects at least seventy percent of the light emitted by the plasma in a narrow wavelength band (about 550 nm to about 620 nm) in the visible spectrum (about 380 nm to about 760 nm) and transmits at least seventy percent of the light emitted from the plasma in the visible spectrum and outside of the narrow band is greater than the CRI of the light emitted from the plasma. (Note that the percentages of light transmitted or reflected relate to the average transmission/reflection of light within the identified band and not the specific transmission/reflection of light at each wavelength in the band.) A suitable coating may comprise alternating layers of silica (the L material) and an oxide of zirconium, tantalum, titanium, niobium, or hafnium (the H material). The overall thickness of the coating may be 3–10 microns with the thickness of individual layers ranging between 0.1–2000 nm.

Table I illustrates the composition of a multilayer coating applied to the outer surface of the arc tube of a typical sodium/scandium lamp (unfiltered CRI 65–70) according to the present invention.

TABLE I

Layer composition and thickness for a 78-layer film of ZrO2/SiO2

| LAYER | MATERIAL | THICKNESS (nm) |
|---|---|---|
| 1 | $ZrO_2$ | 25.39 |
| 2 | $SiO_2$ | 31.03 |
| 3 | $ZrO_2$ | 41.69 |
| 4 | $SiO_2$ | 29.96 |
| 5 | $ZrO_2$ | 57.27 |
| 6 | $SiO_2$ | 29.8 |
| 7 | $ZrO_2$ | 32.24 |
| 8 | $SiO_2$ | 31.3 |
| 9 | $ZrO_2$ | 72.39 |
| 10 | $SiO_2$ | 30.66 |
| 11 | $ZrO_2$ | 29.48 |
| 12 | $SiO_2$ | 30.76 |
| 13 | $ZrO_2$ | 68.5 |
| 14 | $SiO_2$ | 30.78 |
| 15 | $ZrO_2$ | 28.04 |
| 16 | $SiO_2$ | 30.5 |
| 17 | $ZrO_2$ | 64.69 |
| 18 | $SiO_2$ | 30.64 |
| 19 | $ZrO_2$ | 24.31 |
| 20 | $SiO_2$ | 30.52 |
| 21 | $ZrO_2$ | 64.17 |
| 22 | $SiO_2$ | 30.43 |
| 23 | $ZrO_2$ | 23.73 |
| 24 | $SiO_2$ | 30.78 |
| 25 | $ZrO_2$ | 66.68 |
| 26 | $SiO_2$ | 30.85 |
| 27 | $ZrO_2$ | 25.71 |
| 28 | $SiO_2$ | 30.51 |
| 29 | $ZrO_2$ | 66.4 |
| 30 | $SiO_2$ | 30.71 |
| 31 | $ZrO_2$ | 25.13 |
| 32 | $SiO_2$ | 30.47 |
| 33 | $ZrO_2$ | 67.99 |
| 34 | $SiO_2$ | 30.46 |
| 35 | $ZrO_2$ | 24 |
| 36 | $SiO_2$ | 30.93 |
| 37 | $ZrO_2$ | 69.53 |
| 38 | $SiO_2$ | 30.85 |
| 39 | $ZrO_2$ | 22.64 |
| 40 | $SiO_2$ | 30.61 |
| 41 | $ZrO_2$ | 67.84 |
| 42 | $SiO_2$ | 30.72 |
| 43 | $ZrO_2$ | 23.35 |
| 44 | $SiO_2$ | 30.43 |
| 45 | $ZrO_2$ | 66.43 |
| 46 | $SiO_2$ | 30.37 |
| 47 | $ZrO_2$ | 25.34 |
| 48 | $SiO_2$ | 30.91 |
| 49 | $ZrO_2$ | 67.61 |

TABLE I-continued

Layer composition and thickness for a 78-layer film of ZrO2/SiO2

| LAYER | MATERIAL | THICKNESS (nm) |
|---|---|---|
| 50 | $SiO_2$ | 30.77 |
| 51 | $ZrO_2$ | 25.36 |
| 52 | $SiO_2$ | 30.57 |
| 53 | $ZrO_2$ | 66.58 |
| 54 | $SiO_2$ | 30.74 |
| 55 | $ZrO_2$ | 24.96 |
| 56 | $SiO_2$ | 30.41 |
| 57 | $ZrO_2$ | 63.75 |
| 58 | $SiO_2$ | 30.35 |
| 59 | $ZrO_2$ | 26.97 |
| 60 | $SiO_2$ | 30.85 |
| 61 | $ZrO_2$ | 68.31 |
| 62 | $SiO_2$ | 30.71 |
| 63 | $ZrO_2$ | 28.83 |
| 64 | $SiO_2$ | 30.69 |
| 65 | $ZrO_2$ | 72.26 |
| 66 | $SiO_2$ | 31.23 |
| 67 | $ZrO_2$ | 32.68 |
| 68 | $SiO_2$ | 29.87 |
| 69 | $ZrO_2$ | 58.29 |
| 70 | $SiO_2$ | 30.1 |
| 71 | $ZrO_2$ | 42.63 |
| 72 | $SiO_2$ | 30.99 |
| 73 | $ZrO_2$ | 25.26 |
| 74 | $SiO_2$ | 1020.87 |
| 75 | $ZrO_2$ | 21.46 |
| 76 | $SiO_2$ | 21.34 |
| 77 | $ZrO_2$ | 121.69 |
| 78 | $SiO_2$ | 99.84 |

Figure 2:
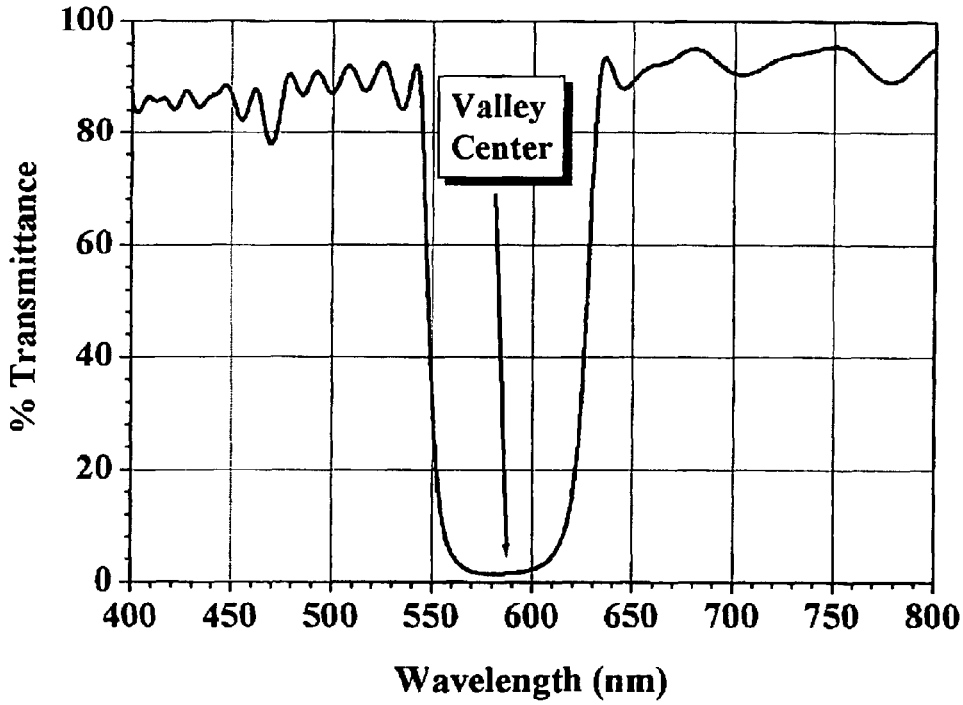
FIG. 2 is an illustration of the transmissivity characteristics of a multilayer coating according to one aspect of the present invention.

As illustrated, the coating disclosed in table I includes alternating layers of SiO2 and ZrO2 and 78 total layers. FIG. 2 illustrates the transmissivity of the coating disclosed in Table I. As illustrated, the coating forms a notch filter that reflects nearly all of the incident light in a narrow band substantially centered on a wavelength of about 590 nm, and transmits nearly eighty percent of the incident light in the visible spectrum and outside of the narrow band. A 400 watt sodium/scandium lamp with the multilayer coating of Table I applied to the outer surface of the arc tube operates at a CCT of 4000 K with a CRI of 85 and a LPW of 85.

Thus according to one aspect of the present invention, the CRI of a sodium/scandium lamp may be raised by 15–20 points while maintaining a relatively efficient lamp.

Figure 3:
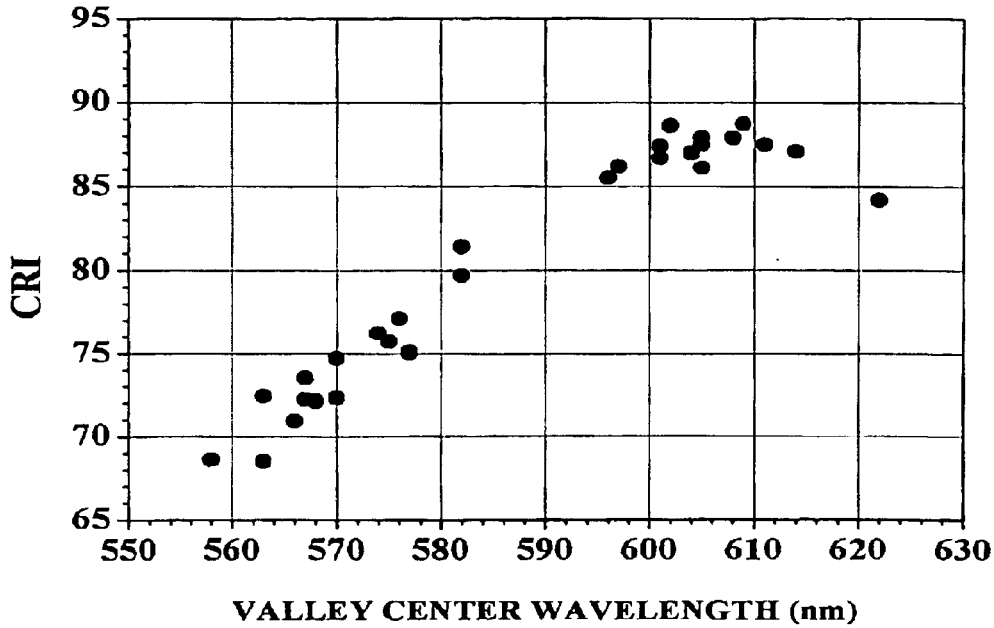
FIG. 3 is an illustration of the variability of the CRI of the light transmitted by filters as a function of the location of the filter center.
Figure 4:
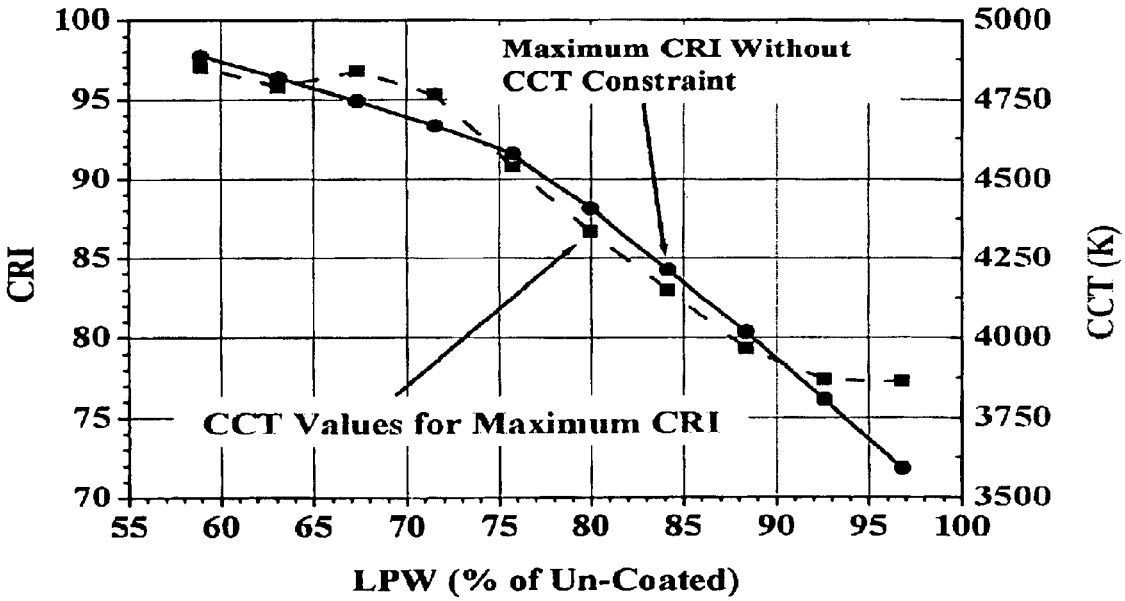
FIG. 4 is an illustration of the variability of the CRI and CCT versus LPW reduction of a sodium/scandium metal halide lamp having an arc tube with a multilayer coating according to one aspect of the present invention.

It has been discovered that a CRI of greater than 90 may be realized in a sodium/scandium lamp depending on the location of the reflected band in the visible spectrum as illustrated in FIG. 3. However, improvements in CRI must be obtained with consideration of any loss in lumen output of the lamp. FIG. 4 illustrates the variability of the CRI and CCT versus LPW reduction of a 400 watt sodium/scandium metal halide lamp having an arc tube with a multilayer coating according to one aspect of the present invention.

In another aspect of the present invention, a multilayer coating may be used in a mercury lamp to reduce the transmission of light emitted at 405 nm and 435 nm to thereby selectively alter the emission spectrum of the lamp. By eliminating emission at wavelengths that are useless or detrimental for an application, the energy efficiency of the lamp can be improved.

Table II illustrates the composition of a multilayer coating applied to the outer surface of the arc tube of a typical mercury lamp according to the present invention.

TABLE II

Layer composition and thickness for a 15-layer film of ZrO2/SiO2

| LAYER | MATERIAL | THICKNESS (nm) |
|---|---|---|
| 1 | ZRO2 | 17.65 |
| 2 | SIO2 | 107.71 |
| 3 | ZRO2 | 35.30 |
| 4 | SIO2 | 107.71 |
| 5 | ZRO2 | 35.30 |
| 6 | SIO2 | 107.71 |
| 7 | ZRO2 | 35.30 |
| 8 | SIO2 | 107.71 |
| 9 | ZRO2 | 35.30 |
| 10 | SIO2 | 107.71 |
| 11 | ZRO2 | 35.30 |
| 12 | SIO2 | 107.71 |
| 13 | ZRO2 | 35.30 |
| 14 | SIO2 | 107.71 |
| 15 | ZRO2 | 17.65 |

Figure 5A:
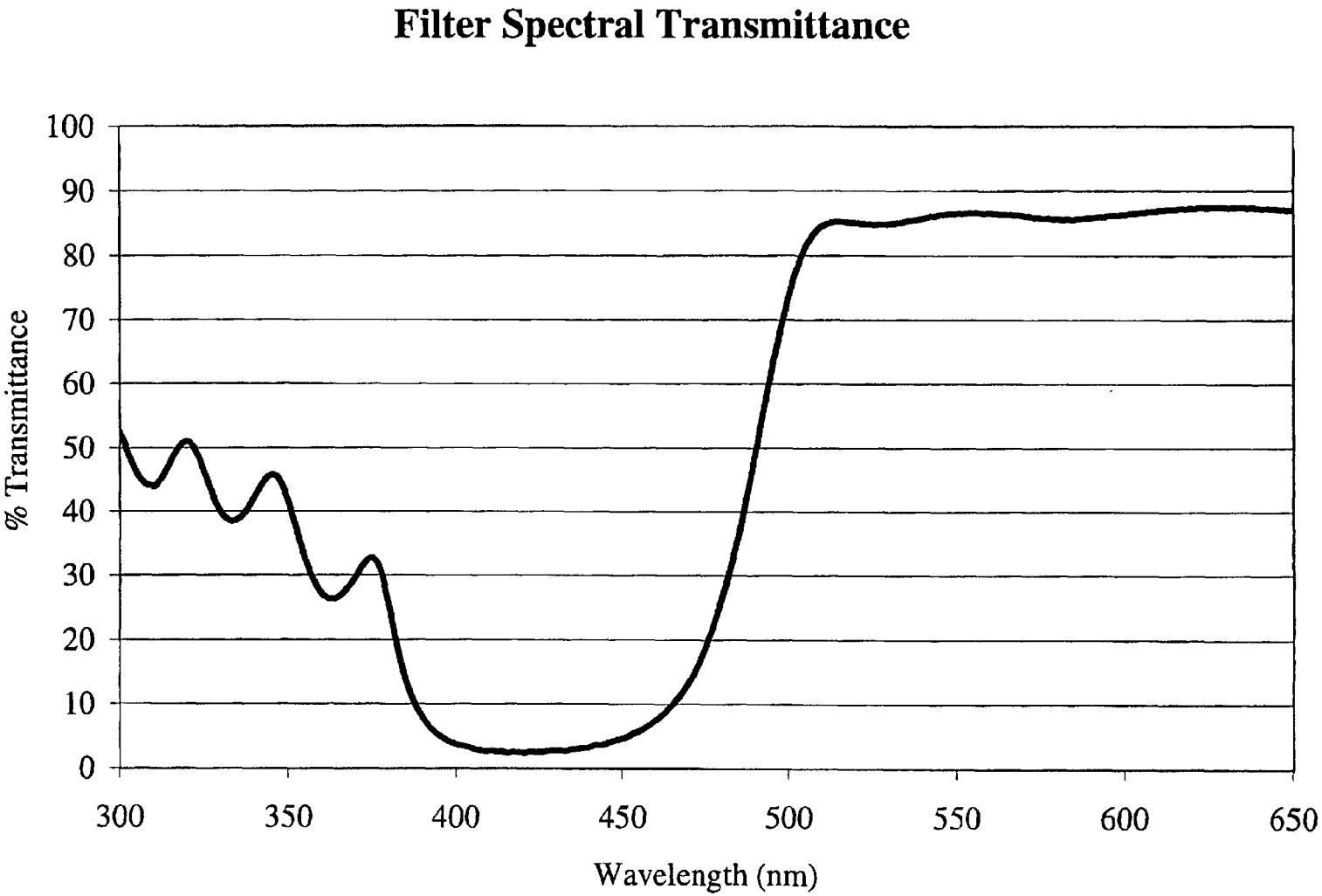
FIG. 5*a* illustrates the transmissivity characteristics of a coating according to another aspect of the present invention.
Figure 5B:
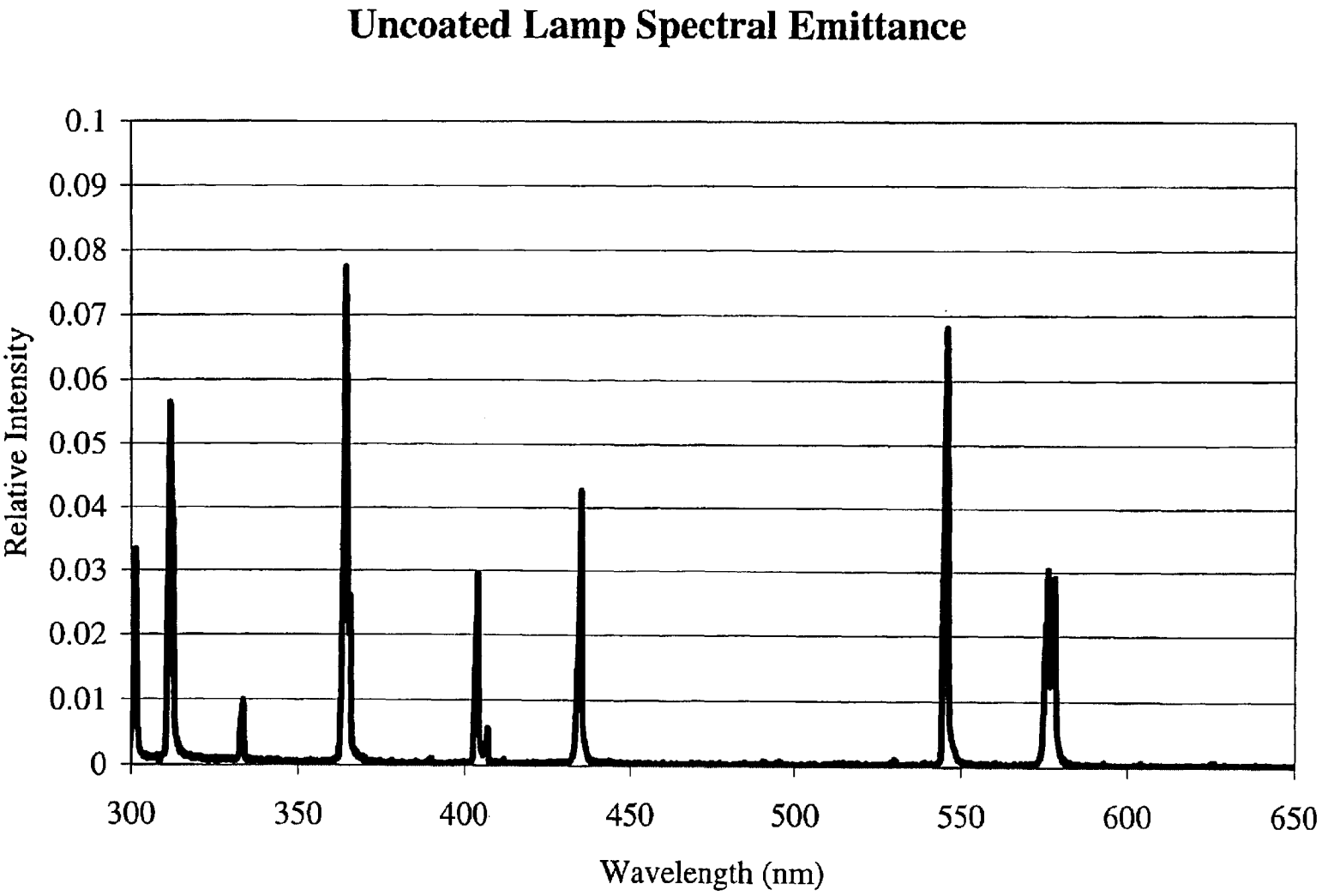
FIGS. 5*b* and 5*c* illustrate the spectral emission from a mercury lamp with no filter and with the filter of FIG. 5*a* respectively.
Figure 5C:
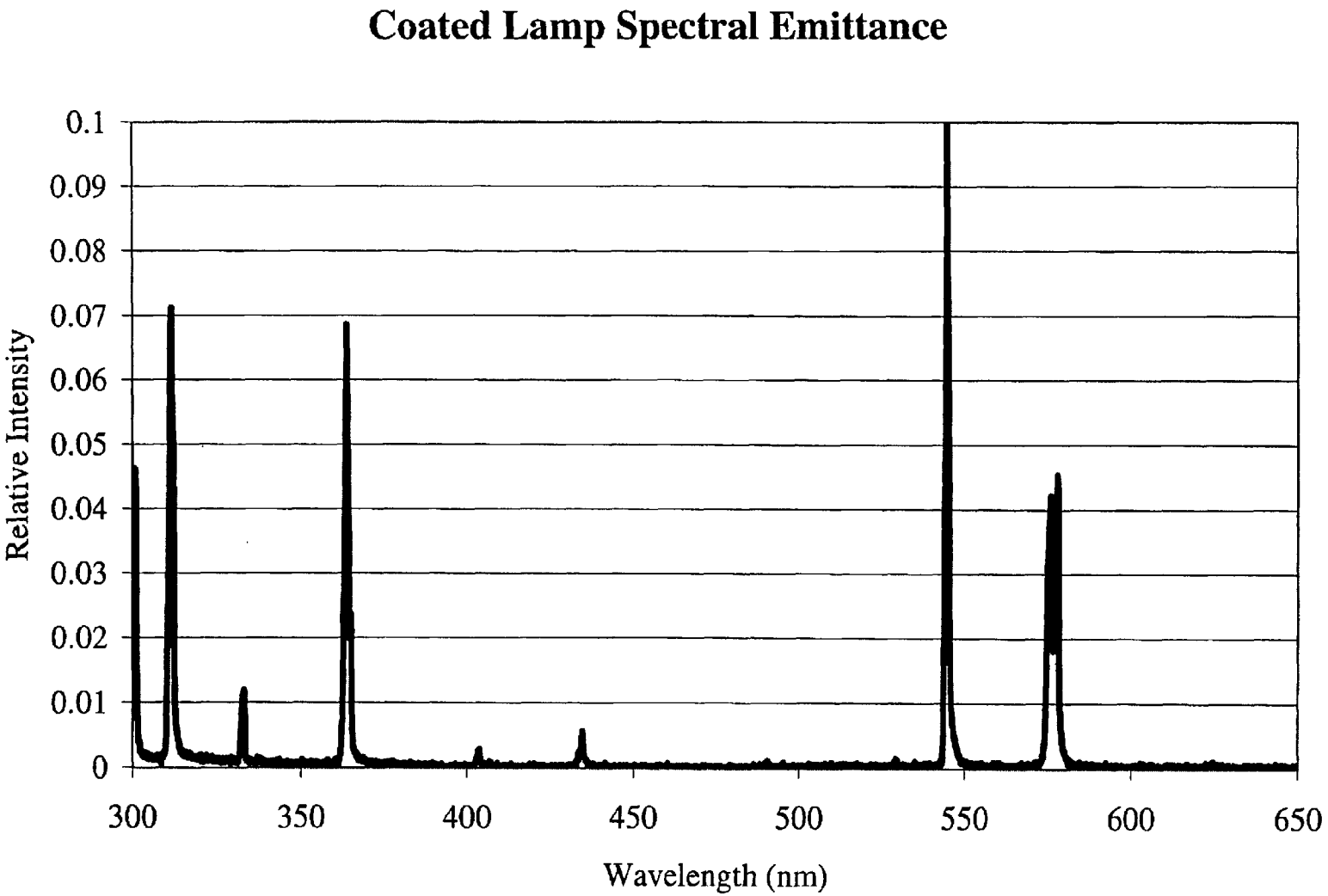

As illustrated, the coating disclosed in Table II includes alternating layers of SiO2 and ZrO2 and 15 total layers. FIG. 5*a* illustrates the transmissivity of the coating disclosed in Table II. As illustrated, the coating reflects nearly all of the incident light at the targeted spectral lines of 405 nm and 435 nm. FIG. 5*b* illustrates the unfiltered spectral emission from a mercury lamp. FIG. 5*c* illustrates the spectral emission from the mercury lamp of FIG. 5*b* with the multilayer coating of table II applied to the arc tube.

The multilayer coatings of the present invention find utility in improving a wide range of operating characteristics in plasma lamps. As disclosed by way of example, the a multilayer coating may be used to improve the CRI of a sodium/scandium lamp or selectively alter the emission spectrum and/or improve the energy efficiency of a mercury lamp. Other advantages in the operating characteristics of such lamps may also be realized by the effects of the coatings on parameters such as the temperature of the arc tube wall, the halide pool distribution, the size and shape of the plasma, and the infrared emission from the lamp.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A high intensity discharge lamp having a vaporizable fill material comprising halides of sodium, scandium, and thorium wherein the operating characteristics of said lamp include a lumens per watt greater than about 85, a color rendering index greater than about 80, and a correlated color temperature between about 3000° K. and about 6000° K.

2. The lamp of claim 1 further comprising a notch filter which reflects at least seventy percent of the light generated by the lamp within a narrow wavelength band in the visible spectrum and transmits at least seventy percent of the light generated by the lamp within the visible spectrum and outside of said narrow band.

3. The lamp of claim 2 wherein the notch filter reflects at least eighty percent of the light generated by the lamp within a narrow wavelength band in the visible spectrum and transmits at least eighty percent of the light generated by the lamp within the visible spectrum and outside of said narrow band.

4. The lamp of claim 2 wherein the narrow wavelength band is substantially centered on a wavelength of about 590 mm.

5. The lamp of claim 2 wherein said notch filter comprises a multilayer coating.

6. The lamp of claim 5 wherein said coating is applied to the outer surface of the arc tube containing said fill material.

7. The lamp of claim 5 further comprising a shroud substantially surrounding the arc tube, wherein said coating is applied to said shroud.

8. The lamp of claim 2 wherein said filter comprises a shroud substantially surrounding the arc tube.

* * * * *